US009915254B2

(12) United States Patent
Wood

(10) Patent No.: US 9,915,254 B2
(45) Date of Patent: Mar. 13, 2018

(54) OIL-FREE AIR COMPRESSOR HAVING VENTED CYLINDER SUPPORTS

(71) Applicant: MAT INDUSTRIES, LLC, Long Grove, IL (US)

(72) Inventor: Mark W. Wood, Cedar Grove, TN (US)

(73) Assignee: MAT INDUSTRIES, LLC., Long Grove, IL (US)

( * ) Notice: Subject to any disclaimer, the term of this patent is extended or adjusted under 35 U.S.C. 154(b) by 377 days.

(21) Appl. No.: 14/718,423

(22) Filed: May 21, 2015

(65) Prior Publication Data

US 2015/0345486 A1 Dec. 3, 2015

Related U.S. Application Data

(60) Provisional application No. 62/003,640, filed on May 28, 2014.

(51) Int. Cl.

| | |
|---|---|
| ***F04B 39/06*** | (2006.01) |
| ***F04B 53/08*** | (2006.01) |
| ***F28F 1/00*** | (2006.01) |
| ***F28D 7/10*** | (2006.01) |
| ***F28F 1/40*** | (2006.01) |
| ***F04B 39/12*** | (2006.01) |

(52) U.S. Cl.

CPC ..... *F04B 39/064* (2013.01); *F04B 39/121* (2013.01); *F04B 53/08* (2013.01); *F28D 7/103* (2013.01); *F28D 7/106* (2013.01); *F28F 1/003* (2013.01); *F28F 1/40* (2013.01)

(58) Field of Classification Search

CPC ..... F04B 39/064; F04B 39/121; F04B 53/08; F28D 7/10; F28D 7/103; F28D 7/106; F28F 1/003; F28F 1/40

See application file for complete search history.

(56) References Cited

U.S. PATENT DOCUMENTS 8,371,828 B2 * 2/2013 Hebrard ..... B22D 19/0072 417/366
8,905,122 B2 * 12/2014 Kim ..... F28F 1/424 165/141

* cited by examiner

*Primary Examiner* — Logan Kraft
(74) *Attorney, Agent, or Firm* — Greer, Burns & Crain, Ltd.

(57) ABSTRACT

A compressor frame structure is provided for providing flow paths of cooling substance near an upper region of a cylinder, and includes a center ring on the frame structure having an opening for accommodating insertion of the cylinder, a plurality of flow channels near the upper region of the cylinder around an inner surface of the frame structure, and wherein the plurality of flow channels include a plurality of outer flow channels around an outer circumferential surface of the center ring, and a plurality of inner flow channels around an inner circumferential surface of the center ring.

9 Claims, 8 Drawing Sheets

OIL-FREE AIR COMPRESSOR HAVING VENTED CYLINDER SUPPORTS

RELATED APPLICATION

This application claims priority under 35 USC 119(e) from U.S. Provisional Application No. 62/003,640 filed May 28, 2014.

BACKGROUND

The present disclosure generally relates to pneumatic compressors, and more particularly relates to an oil-free air compressor used for supplying compressed air to a pneumatic tool.

Conventional air-cooled compressors have an open frame structure for supporting a cylinder having a compression chamber, and for providing the mounting point for other compressor components. The cylinder typically has a mounting flange on its upper end adjacent a valve plate, and is commonly made of cast aluminum or steel. During compressor assembly, the cylinder is inserted into, and held by a port in the frame structure. Specifically, the cylinder flange is axially confined from below by an annular region around the port, and from above by the valve plate and a valve plate sealing gasket.

In operation, gases are rapidly heated in the cylinder. To improve efficiency of the compressor, and protect associated components, most conventional compressors use cooling air or liquid to remove thermal energy from the cylinder. Effective cooling of the cylinder is important because the cylinder is a significant part of the compression cavity. Typically, the highest temperature of the cylinder is measured at the top of the cylinder close to the valve plate, because a pressure of the gas is higher at the top than the pressure at the bottom. Thus, the top portion of the cylinder is the most important region to cool.

However, the frame structure of conventional compressors restricts the flow of cooling air or liquid to the top portion or region of the cylinder, thereby causing the temperature of the cylinder to rise significantly during operation, reducing the operational life of certain components, and in some cases damaging the cylinder and adjacent components. Thus, there is a need for developing an improved frame structure for cooling the top region of the cylinder during a compression process.

SUMMARY

The present disclosure is directed to an air compressor frame structure, preferably for an oil free compressor having a plurality of flow channels at an upper or top region of a cylinder. A feature of the present frame structure is an improved flow path for cooling air or liquid near the top region of the cylinder. One aspect of the present frame structure is that, as described in further detail below, the flow channels are provided around an inner surface of the frame structure.

In one embodiment, the compressor cylinder is supported by a relatively open cylinder port support structure including plurality of frame standoffs or cylinder support pads that support a mounting flange of the cylinder and define a plurality of air channels around an exterior surface of the cylinder. In another embodiment, a plurality of outer flow channels is provided around an outer circumferential surface of a center ring, and a plurality of inner flow channels are provided around an inner circumferential surface of the center ring. The center ring has an opening configured for accommodating and supporting the cylinder.

Another important aspect is that the center ring has a plurality of the cylinder port support members for supporting an outer surface of the cylinder. Each support member has a support pad and a bridge for connecting the center ring to the inner surface of the frame structure. Specifically, a side surface of each support pad is oriented toward a longitudinal axis of the center ring for abutting or supporting the outer surface of the cylinder. This configuration of the cylinder port support members improves dimensional stability and cooling efficiency.

Yet another important aspect is that the center ring has a plurality of flow windows positioned between the cylinder port support members for connecting the inner flow channels and the outer flow channels. When the cooling air or fluid travels in the outer flow channel at a high speed, the air or fluid flow in the outer flow channel induces streams of cooling air or fluid through the flow windows from the inner flow channel by generating a vacuum or Venturi effect. Thus, the flow windows increase an overall flow rate of cooling air or liquid around the top region of the cylinder during the compression process.

More specifically, a compressor frame structure is provided for providing flow paths of cooling substance near an upper region of a cylinder, and includes a center ring on the frame structure having an opening for accommodating insertion of the cylinder, a plurality of flow channels near the upper region of the cylinder around an inner surface of the frame structure, and wherein the plurality of flow channels include a plurality of outer flow channels around an outer circumferential surface of the center ring, and a plurality of inner flow channels around an inner circumferential surface of the center ring.

In another embodiment, a compressor frame structure is provided for providing flow paths of cooling substance near a flange of a cylinder, a plurality of support pads projecting inwardly from an inner surface of the frame, the pads engaging the flange, being the sole support for the flange on the frame and defining a plurality of flow channels which enhance air flow in the frame around the cylinder.

In still another embodiment, a compressor frame structure is provided for providing flow paths of cooling substance near an upper region of a cylinder, and includes the frame structure defining a plurality of circumferentially spaced support members configured for supporting the cylinder and for defining flow passages between the frame structure and the cylinder for promoting cooling of the cylinder.

DETAILED DESCRIPTION

Figure 1:
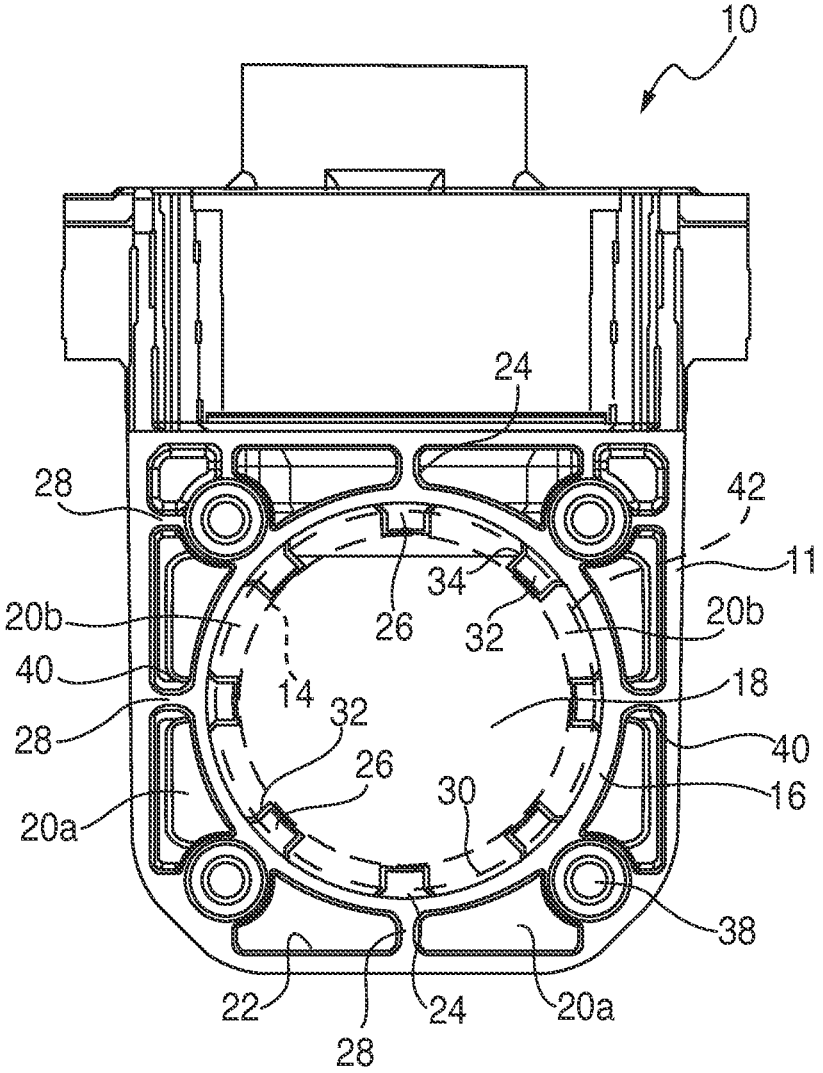
FIG. 1 is a plan view of the present air compressor frame structure featuring a plurality of flow channels.
Figure 2:
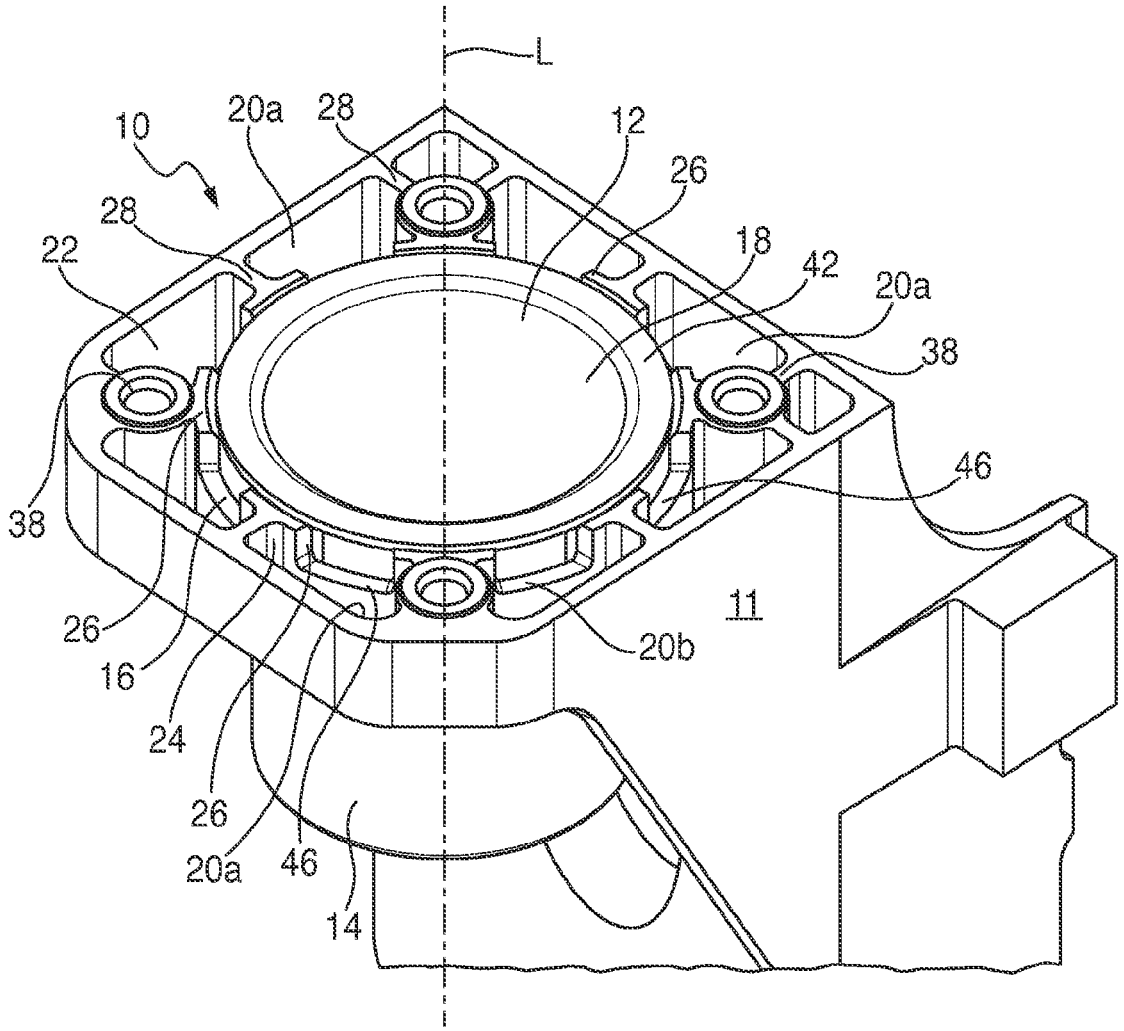
FIG. 2 is a top perspective view of the frame structure of FIG. 1 including an inserted cylinder.
Figure 3:
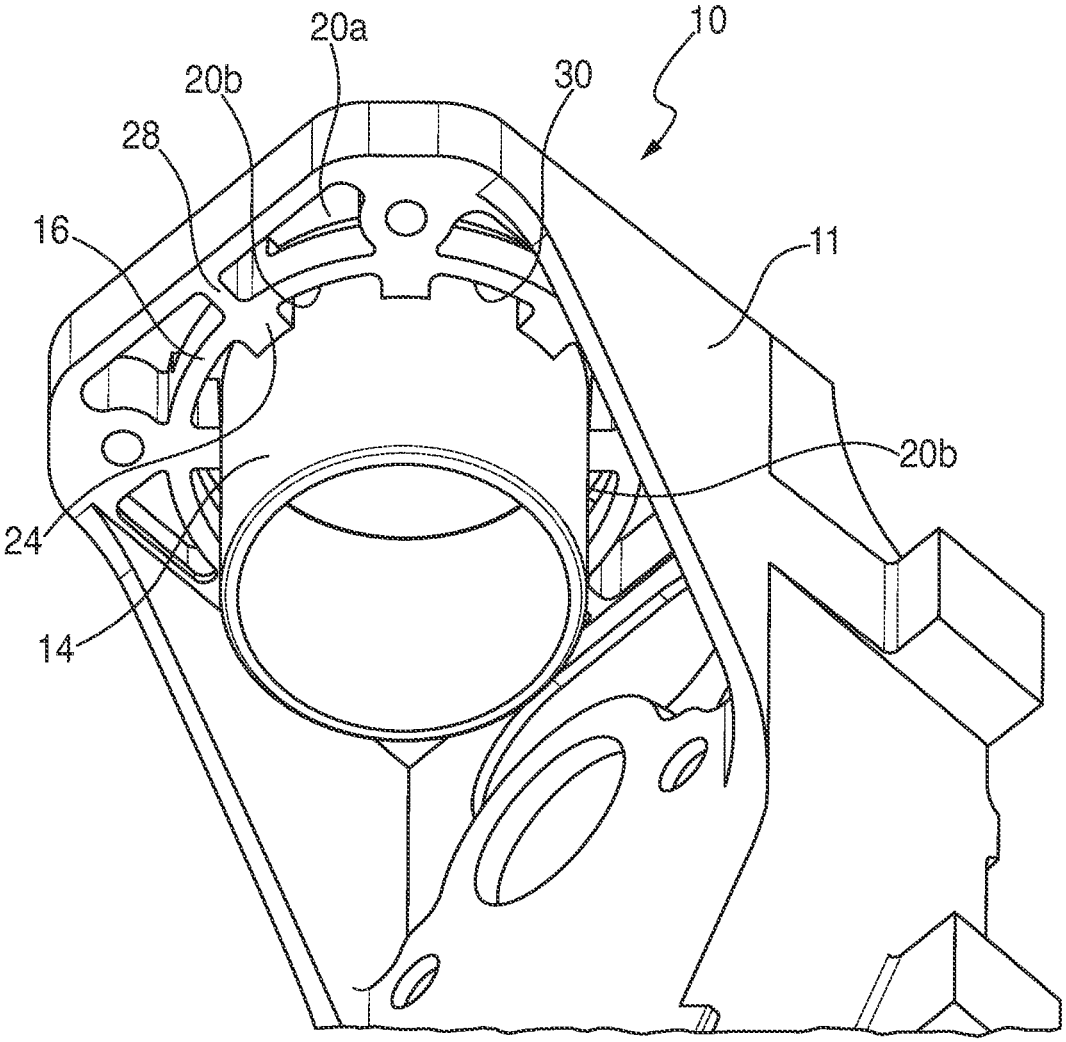
FIG. 3 is a bottom perspective view of the frame structure of FIG. 1.
Figure 4:
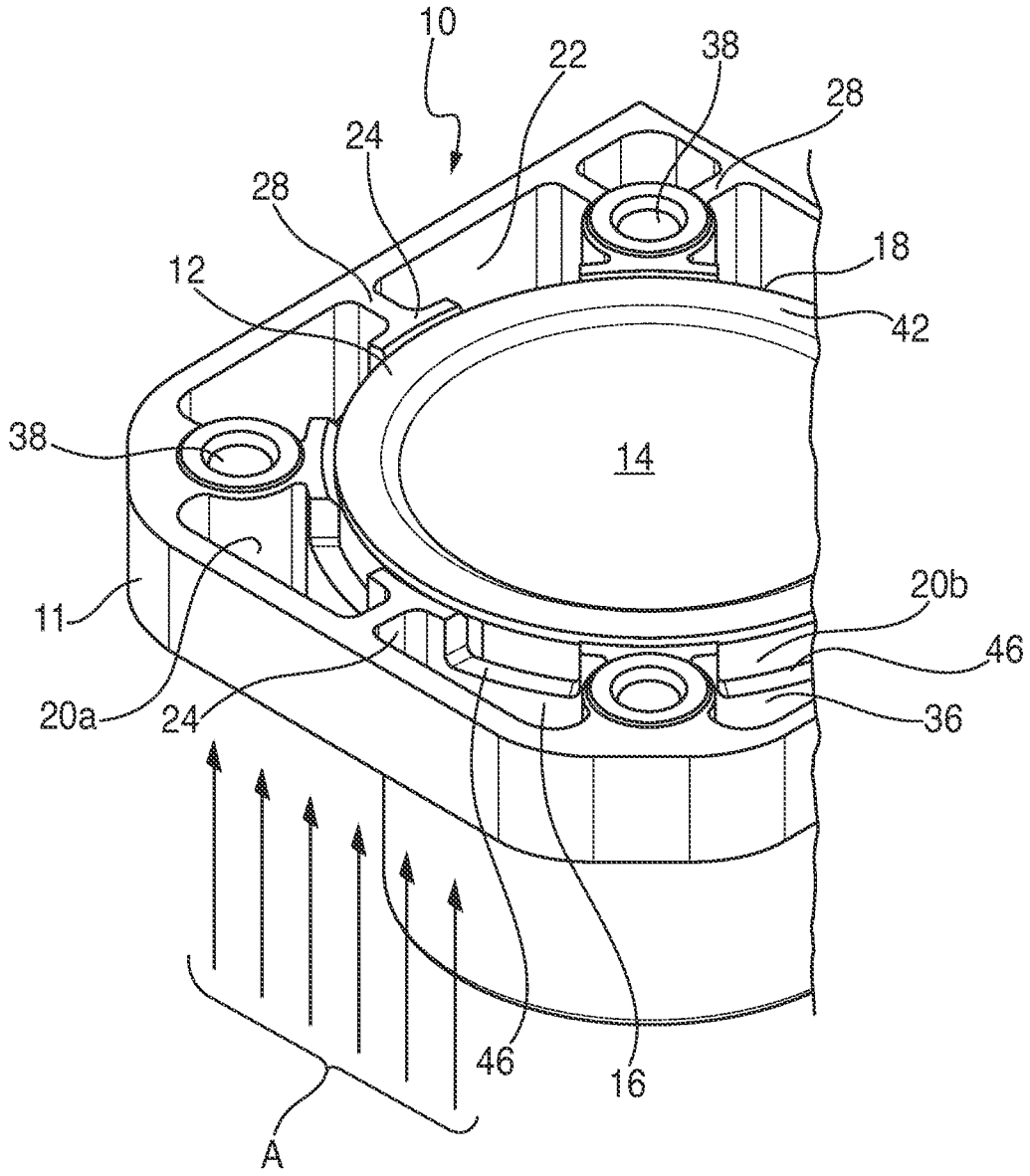
FIG. 4 is an enlarged fragmentary top perspective view of the frame structure of FIG. 2 including an inserted cylinder.

Referring now to FIGS. 1-4, the present air compressor frame structure is generally designated 10 and is designed to provide flow paths of cooling substance, such as air or liquid, near an upper or top region 12 of a cylinder 14 (FIGS. 2-4). It is contemplated that the frame structure 10 includes a frame body 11 defining a center ring 16 integrally formed with the frame structure 10 and defining an opening 18 for accommodating insertion of the cylinder 14. Also included in the frame structure 10 is a plurality of flow channels 20*a*, 20*b* near the top region 12 of the cylinder 14 around an inner surface 22 of the frame structure. Specifically, it is preferred that a plurality of outer flow channels 20*a* are provided around an outer circumferential surface of the center ring 16, and a plurality of inner flow channels 20*b* are provided around an inner circumferential surface of the center ring. Although a generally triangular-shaped outer flow channel 20*a* is shown for illustration purposes, other suitable shapes of flow channels 20*a*, 20*b* are contemplated to suit different applications.

An important aspect of the present frame structure 10 is that the center ring 16 has a plurality of cylinder port support members 24 for supporting an outer circumferential surface of the cylinder 14. Each, preferably cylindrically spaced support member 24 has a support pad or projection 26, and at least one bridge 28 for connecting the center ring 16 to the inner surface 22 of the frame structure 10. Specifically, each support pad 26 extends from an inner surface 30 of the center ring 16, and a side surface 32 of each support pad 26 is oriented toward a longitudinal axis L of the center ring 16 for abutting or supporting the outer surface of the cylinder 14. As a result, when the cylinder 14 is inserted into the opening 18 of the center ring 16, each inner flow channel 20*b* is defined by the outer circumferential surface of the cylinder 14, the inner surface 30 of the center ring 16, and side walls 34 of adjacent support pads 26.

In a preferred embodiment, each bridge 28 is attached at one end to the inner surface 22 of the frame structure 10, and at an opposite end is attached to an outer surface 36 of the center ring 16. Optionally, selected bridges 28 have a helically threaded bore 38 for receiving a fastener (not shown). For example, a valve plate (not shown) can be securely fastened to the frame structure 10 by threadably fastening the fasteners into the threaded bores 38. Similarly, with the inner flow channel 20*b*, each outer flow channel 20*a* is defined by the inner surface 22 of the frame structure 10, the outer surface 36 of the center ring 16, and side walls 40 of adjacent bridges 28. This configuration of the cylinder port support members 24 improves dimensional stability of the frame structure 10.

Referring now to FIGS. 2 and 4, it is also contemplated that the cylinder 14 has a mounting flange 42 extending radially outwardly on an upper edge of the cylinder such that when the cylinder is inserted into the opening 18 of the center ring 16, the flange rests on top of the support pads 26. Consequently, when assembled, both outer and inner flow channels 20*a*, 20*b* surround the outer circumferential surface of the cylinder 14 for providing a flow of cooling air or liquid to the top region 12 of the cylinder. Such an arrangement of dual flow channels 20*a*, 20*b* improves cooling efficiency of the frame structure 10, and especially near the top region 12 of the cylinder where the cooling is required the most during the compression process.

Referring now to FIG. 4, it is also contemplated that the center ring 16 has a plurality of flow windows 46 positioned between adjacent cylinder port support members 24 for connecting the outer flow channels 20*a* and the inner flow channels 20*b*. Although square shaped windows 46 are shown for illustration purposes, other suitable shapes are also contemplated to suit the situation. In operation, when the cooling air or fluid, indicated by graphic arrows A, travels in the outer flow channels 20*a* at a high speed, the air or fluid flow in the outer flow channels induces streams of cooling air or fluid through the flow windows 46 from the inner flow channels 20*b* by generating a vacuum or Venturi effect. As is known in the art, the Venturi effect created within and near the flow windows 46 accelerates a flow speed of the cooling air or fluid in the inner flow channels 20*b*, and consequently enhances the cooling efficiency around the cylinder 14. As a result, the flow windows 46 increase an overall flow rate of cooling air or liquid around the top region 12 of the cylinder 14 during the compression process.

Figure 5:
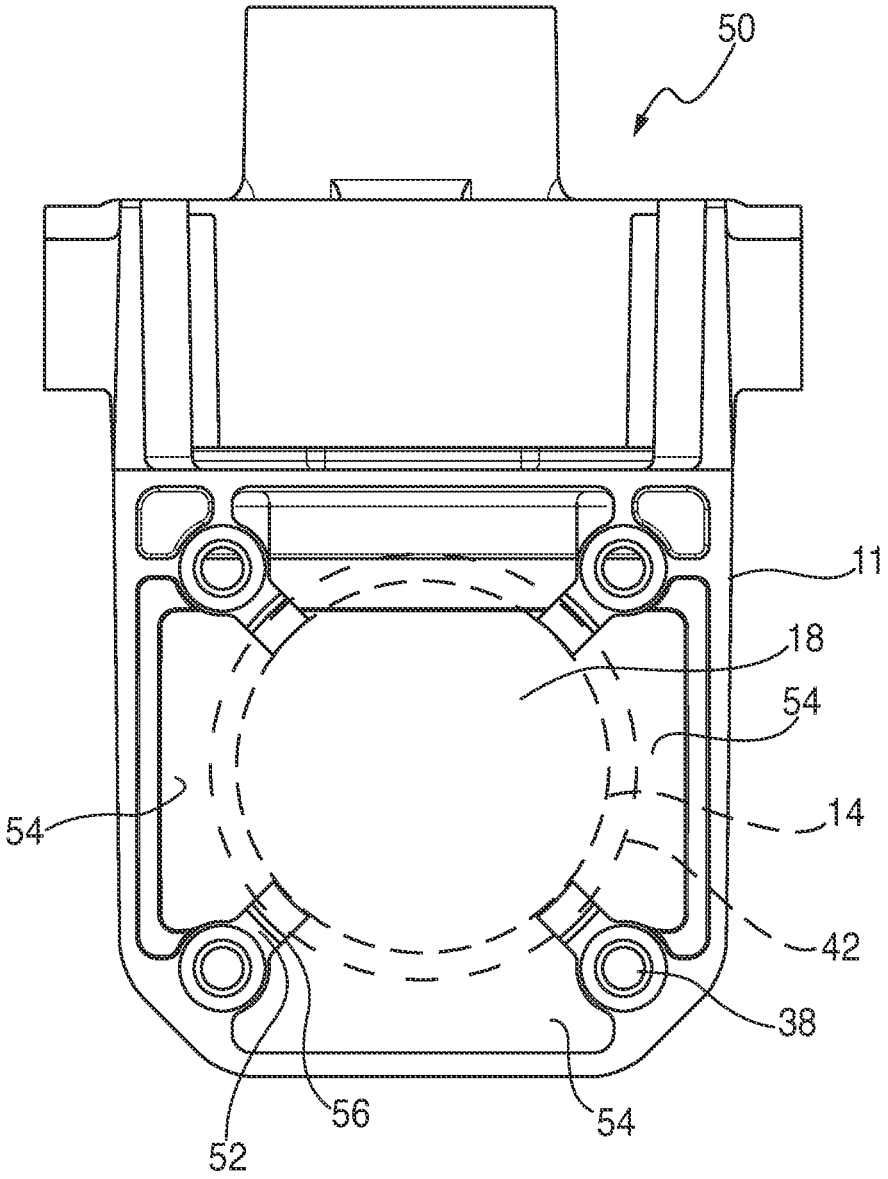
FIG. 5 is a plan view of another embodiment of the present air compressor frame structure.
Figure 6:
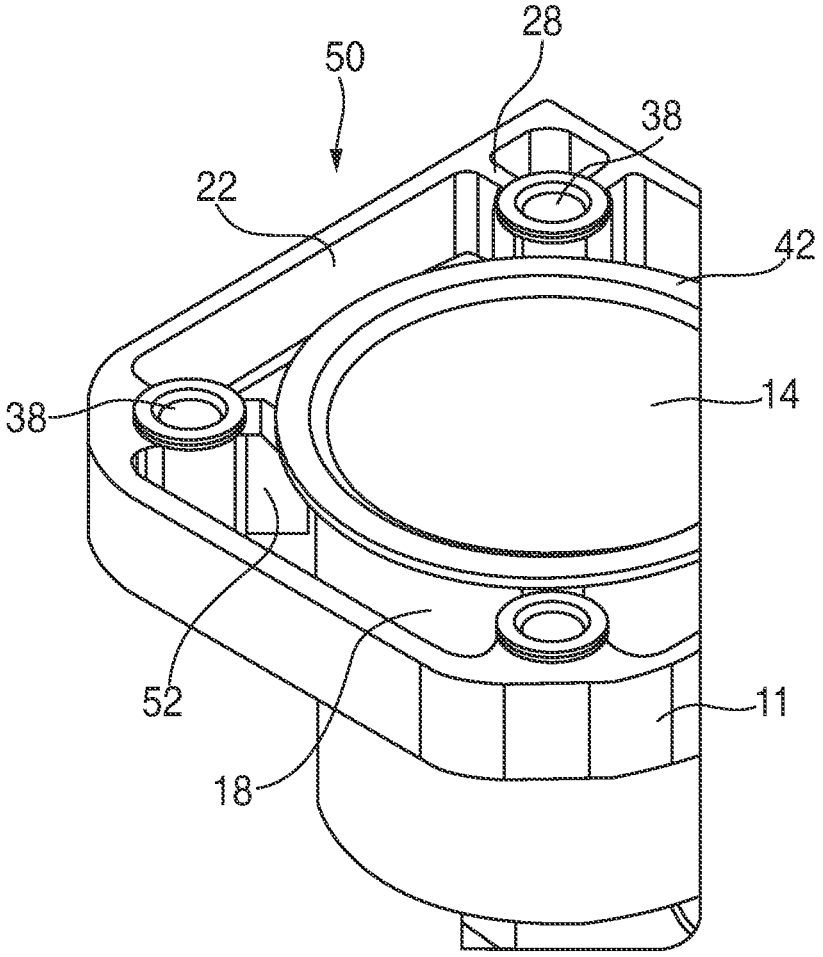
FIG. 6 is a top perspective view of the air compressor frame of FIG. 5 including an inserted cylinder.
Figure 7:
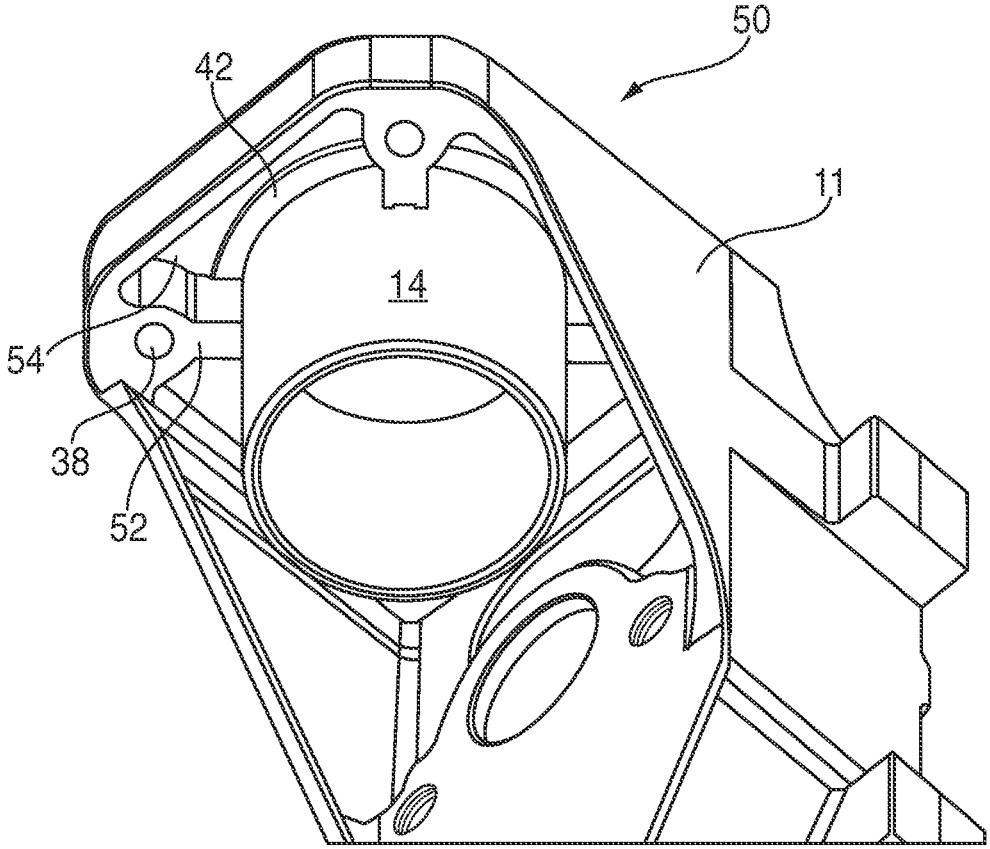
FIG. 7 is a bottom perspective view of the air compressor frame of FIG. 6.

Referring now to FIGS. 5-7, another embodiment of the present air compressor frame is generally designated 50. Components shared with the frame 10 are designated with identical reference numbers. A main difference between the frames 10 and 50 is that the latter lacks the center ring 16 and its attendant structure. Instead, the flange 42 of the cylinder 14 is supported in the frame 50 solely by supports, or support pads 52 which project inwardly from the inner surface 22 of the frame. In the preferred embodiment, there are only four supports 52, each of which is associated with one of the threaded bores 38. It is contemplated that the number and positioning of the supports 52 may vary to suit the application. Also, each of the supports engages an underside of the cylinder flange 42. As a result, air flow around the cylinder 14 is even further enhanced than in the frame 10. However, there is only one type of flow channel 54, defined between the cylinder exterior, the inner frame surface 22 and sides 56 of the supports 52.

Figure 8:
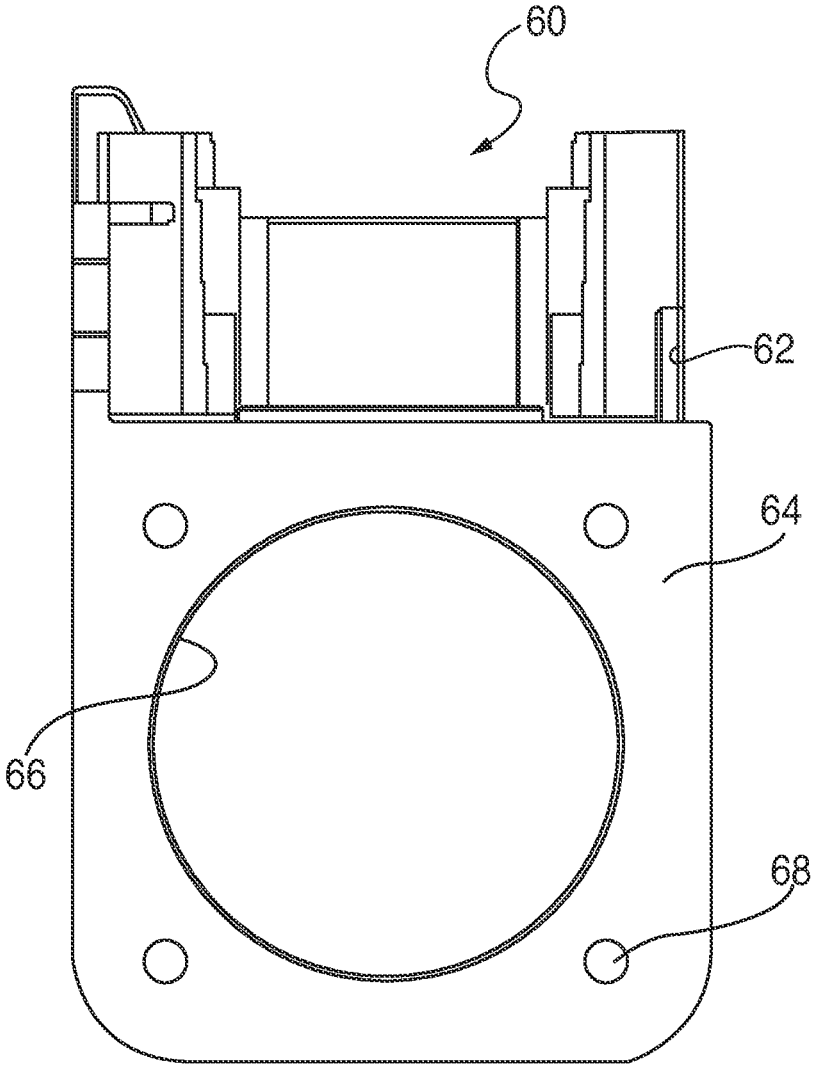
FIG. 8 PRIOR ART
FIG. 8 is a plan view of a prior art compressor frame structure.

Referring now to FIG. 8, in contrast to the present compressor frames 10, 50, a prior art compressor frame is generally designated 60. A frame body 62 includes a solid flange 64 defining an opening 66 dimensioned to accommodate the cylinder (not shown). The cylinder is held in place by a clamping plate (not shown), which is secured to the flange 64 by fasteners engaging the mounting bores 68. It has been found that this design suffers from high operational temperatures as described above in the Background.

While a particular embodiment of the present oil free air compressor having vented cylinder supports has been described herein, it will be appreciated by those skilled in the art that changes and modifications may be made thereto without departing from the present disclosure in its broader aspects.

The invention claimed is:

1. A compressor frame structure for providing flow paths of cooling substance near an upper region of a cylinder, comprising:

a center ring on said frame structure having an opening for accommodating insertion of the cylinder;

a plurality of flow channels near the upper region of the cylinder around an inner surface of the frame structure;

the plurality of flow channels include a plurality of outer flow channels around an outer circumferential surface of the center ring, and a plurality of inner flow channels around an inner circumferential surface of the center ring;

said center ring is provided with a plurality of circumferentially spaced support members constructed and arranged for supporting the cylinder; and each said support member includes a support pad configured for receiving a flange of the cylinder, and at least one bridge configured for connected said center ring to the frame structure.

2. The compressor frame structure of claim 1, wherein each said support pad extends from an inner surface of the center ring, and a side surface of each support pad is oriented toward a longitudinal axis of the center ring for abutting or supporting the outer surface of the cylinder.

3. The compressor frame structure of claim 1, wherein each said bridge is attached at one end to an inner surface of said frame structure, and at an opposite end is attached to an outer surface of said center ring.

4. The compressor frame structure of claim 1, further including a plurality of flow windows being positioned between adjacent cylinder port support members for connecting the outer flow channels and the inner flow channels such that a flow speed of the cooling substance in the inner flow channels is accelerated for enhancing a cooling efficiency around the cylinder.

5. A compressor frame structure for providing flow paths of cooling substance near a flange of a cylinder, comprising:

a plurality of support pads projecting inwardly from an inner surface of the frame;

said pads engaging the flange, being the sole support for said flange on said frame and defining a plurality of flow channels which enhance air flow in said frame around the cylinder.

6. The compressor frame structure of claim 5, wherein each said pad is constructed and arranged to engage an underside of the cylinder flange.

7. The compressor frame structure of claim 5, wherein each of said flow channels is defined between a cylinder exterior, said inner frame surface and sides of said supports.

8. A compressor frame structure for providing flow paths of cooling substance near an upper region of a cylinder, comprising:

said frame structure defining a plurality of circumferentially spaced support members configured for supporting the cylinder and for defining flow passages between said frame structure and the cylinder for promoting cooling of the cylinder; and at least one said support member includes a support pad configured for receiving a flange of the cylinder, and at least one bridge configured for connected a center ring to the frame structure.

9. The compressor frame structure of claim 8, wherein each said support pad extends from an inner surface of the center ring, and a side surface of each support pad is oriented toward a longitudinal axis of the center ring for abutting or supporting the outer surface of the cylinder.

* * * * *